US008540342B2

(12) United States Patent
Kanzaki

(10) Patent No.: US 8,540,342 B2
(45) Date of Patent: Sep. 24, 2013

(54) RECORDING APPARATUS, METHOD OF CONTROLLING RECORDING APPARATUS AND COMPUTER READABLE RECORDING MEDIUM

(75) Inventor: Takashi Kanzaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 838 days.

(21) Appl. No.: 12/731,015

(22) Filed: Mar. 24, 2010

(65) Prior Publication Data

US 2010/0245919 A1 Sep. 30, 2010

(30) Foreign Application Priority Data

Mar. 31, 2009 (JP) ..... 2009-084155

(51) Int. Cl.
*B41J 2/165* (2006.01)

(52) U.S. Cl.
USPC ..... 347/35

(58) Field of Classification Search
USPC ..... 347/35
See application file for complete search history.

(56) References Cited

U.S. PATENT DOCUMENTS 7,431,420 B2 * 10/2008 Inoue ..... 347/30
8,287,066 B2 * 10/2012 Jackson et al. ..... 347/35
2006/0214979 A1 9/2006 Inoue

FOREIGN PATENT DOCUMENTS

JP 2002-178534 A 6/2002
JP 2004-98298 A 4/2004
JP 2006-272571 A 10/2006
JP 2007-136722 A 6/2007

OTHER PUBLICATIONS

Notification of Reason for Refusal dated Feb. 1, 2011 for corresponding Japanese Patent Application No. 2009-084155 together with English language translation.

* cited by examiner

*Primary Examiner* — Julian Huffman
(74) *Attorney, Agent, or Firm* — Scully, Scott, Murphy & Presser, PC

(57) ABSTRACT

Positions of flushing candidate pixels are provided in standard areas S formed from pixels arranged in a matrix pattern. A reference area formation section forms a reference area Ref by arranging two standard areas S adjacently to each other in both a main scan direction and a conveyance direction. In a range where there are overlaps with virtual pixel rows 84 not associated with image dots for a virtual flushing area F virtually arranged at a randomly-determined position in the reference area Ref, an extraction section extracts pixels overlapping flushing candidate pixels in the reference area Ref. A head control section controls inkjet heads such that image dots and flushing dots corresponding to the extracted pixels are formed on a sheet P.

11 Claims, 11 Drawing Sheets

RECORDING APPARATUS, METHOD OF CONTROLLING RECORDING APPARATUS AND COMPUTER READABLE RECORDING MEDIUM

CROSS REFERENCE TO RELATED APPLICATION

The present application claims priority from Japanese Patent Application No. 2009-084155, which was filed on Mar. 31, 2009, the disclosure of which is incorporated herein by reference in its entirety.

BACKGROUND

The present invention relates to a recording apparatus having a liquid ejection head for ejecting a liquid, a method of controlling the recording apparatus and a computer readable recording medium storing a program.

A plurality of nozzles for ejecting ink droplets to a recording medium, such as a print sheet, are formed in an inkjet head provided in an inkjet printer. In such an inkjet head, viscosity of ink in the nozzles increases with elapse of a time, thereby sometimes causing a change in an ink ejection characteristic and an ejection failure. A hitherto known technique for preventing them is to produce image dots pertaining to an image on a recording medium in such a way that ink droplets are ejected from all nozzles before elapse of a predetermined time and to produce flushing dots on the recording medium by causing nozzles, which do not contribute to image production, to eject ink droplets. An increase in the viscosity of the ink in the nozzles can thereby be prevented without wasting the recording medium.

SUMMARY

According to the foregoing technique, in order to reduce visibility of flushing dots produced on a sheet, positions of the flushing dots are determined so as not to overlap each other or adjoin each other. However, according to the technique, positions of the flushing dots are previously determined, the probability of flushing dots being produced at the same locations on a plurality of sheets is high, so that flushing dots become prone to being noticeable. Meanwhile, when an attempt is made to store positions of flushing dots produced on one sheet or a plurality of sheets and individually determine positions of the respective flushing dots such that the flushing dots are not produced at the stored positions of the flushing dots in order to prevent production of flushing dots at the same positions on a plurality of sheets, amounts of arithmetic processing become enormous.

An object of the present invention is to provide a recording apparatus that can quickly determine positions of spare ejection dots through processing involving small amount of arithmetic processing and that can inhibit production of the spare ejection dots at the same positions on any recording medium.

In order to achieve the object, an exemplary embodiment of the present invention provides a recording apparatus comprising:

a conveyance mechanism which conveys a recording medium in a conveyance direction;

a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction;

an image data storage which stores image data showing, in a recording area defined in the recording medium, positions of image dots produced at intervals commensurate with the first resolution in the orthogonal direction and a second resolution in the conveyance direction;

a flushing area size storage which stores the number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

a standard flushing data storage which stores standard flushing data showing a standard flushing pattern within a standard area, wherein the standard area includes a plurality of elements rows having spatial elements arranged in the conveyance direction and has the same matrix shape as the virtual flushing area, and the standard flushing pattern includes flushing coordinate elements which are selected at least one from the spatial elements of each of the element rows of the standard area;

a reference area formation unit which repeatedly arranges the plural standard areas in at least one of the conveyance direction and the orthogonal direction to form a reference area;

an extraction unit which virtually arrange the virtual flushing area on an arbitrary position within the reference area, and selects the element row, in which the image dot is not included, from the element rows of the flushing area when the recording area is arranged on the flushing area, and extracts the coordinate element within the reference area in the selected element row as a flushing element; and an ejection controller which controls the ejection ports to eject droplets based on the image data and the flushing element extracted by the extraction unit.

Further, the exemplary embodiment of the present invention provides a method of controlling a recording apparatus which includes a conveyance mechanism which conveys a recording medium in a conveyance direction; and a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction, the method comprising:

storing image data showing, in a recording area defined in the recording medium, positions of image dots produced at intervals commensurate with the first resolution in the orthogonal direction and a second resolution in the conveyance direction;

storing the number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

storing standard flushing data showing a standard flushing pattern within a standard area, wherein the standard area includes a plurality of elements rows having spatial elements arranged in the conveyance direction and has the same matrix shape as the virtual flushing area, and the standard flushing pattern includes flushing coordinate elements which are selected at least one from the spatial elements of each of the element rows of the standard area;

repeatedly arranging the plural standard areas in at least one of the conveyance direction and the orthogonal direction to form a reference area;

virtually arranging the virtual flushing area on an arbitrary position within the reference area;

selecting the element row, in which the image dot is not included, from the element rows of the flushing area when the recording area is arranged on the flushing area, and extracts the coordinate element within the reference area in the selected element row as a flushing element; and controlling the ejection ports to eject droplets based on the image data and the extracted flushing element.

Further, the exemplary embodiment of the present invention provides a computer readable recording medium storing a program which causes a recording apparatus, which includes a conveyance mechanism which conveys a recording medium in a conveyance direction; and a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction, to perform:

storing image data showing, in a recording area defined in the recording medium, positions of image dots produced at intervals commensurate with the first resolution in the orthogonal direction and a second resolution in the conveyance direction;

storing the number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

storing standard flushing data showing a standard flushing pattern within a standard area, wherein the standard area includes a plurality of elements rows having spatial elements arranged in the conveyance direction and has the same matrix shape as the virtual flushing area, and the standard flushing pattern includes flushing coordinate elements which are selected at least one from the spatial elements of each of the element rows of the standard area;

repeatedly arranging the plural standard areas in at least one of the conveyance direction and the orthogonal direction to form a reference area;

virtually arranging the virtual flushing area on an arbitrary position within the reference area;

selecting the element row, in which the image dot is not included, from the element rows of the flushing area when the recording area is arranged on the flushing area, and extracts the coordinate element within the reference area in the selected element row as a flushing element; and controlling the ejection ports to eject droplets based on the image data and the extracted flushing element.

DESCRIPTION OF EXEMPLARY EMBODIMENTS

A preferred embodiment of the present invention is hereunder described by reference to the drawings.

Figure 1:
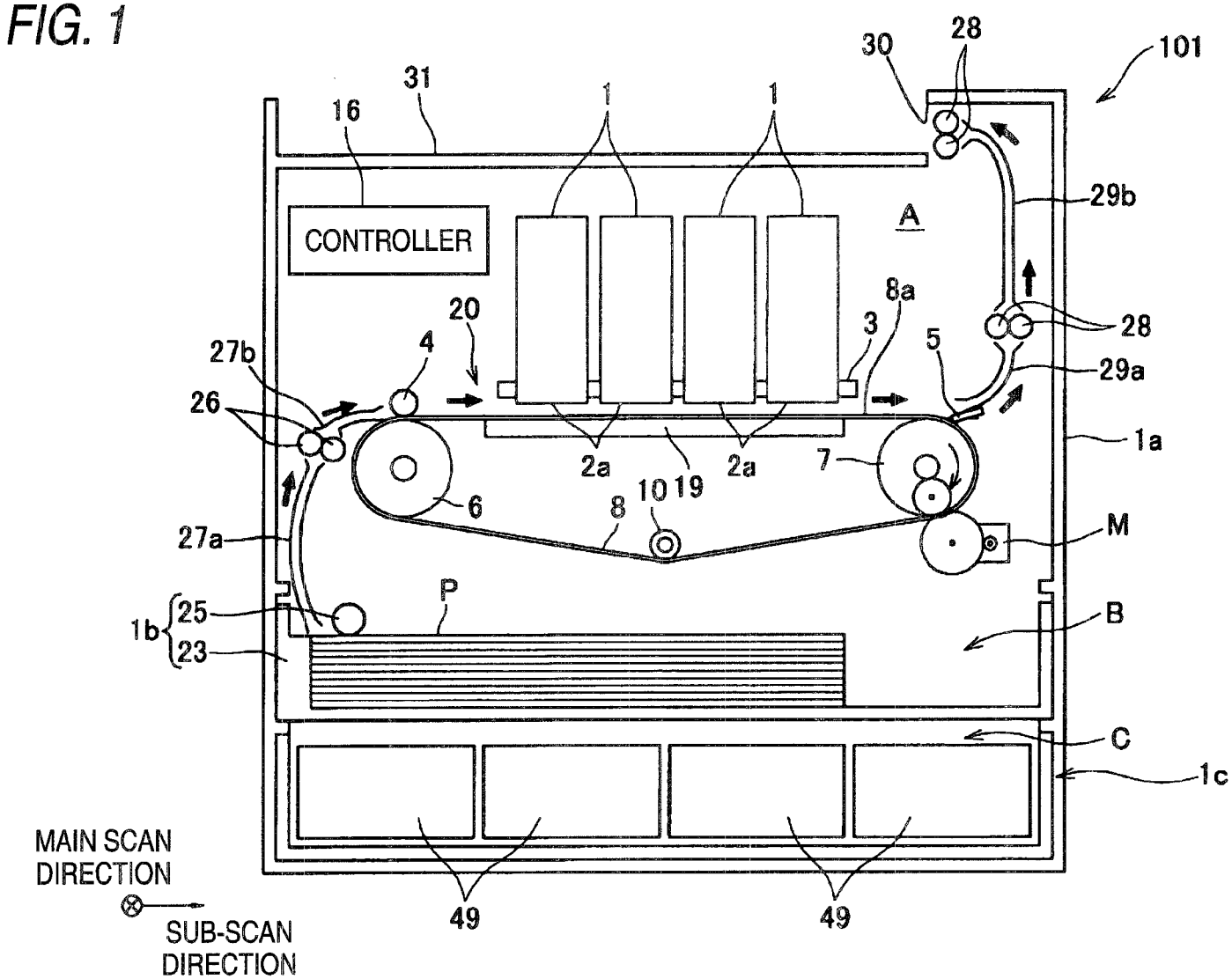
FIG. 1 is a cross sectional view of an inkjet printer of an embodiment of the present invention.

As shown in FIG. 1, an inkjet printer 101 includes a parallelepiped housing 1*a*. A sheet output section 31 is provided in an upper portion of the housing 1*a*. An interior of the housing 1*a* is divided, in sequence from top, three spaces A, B, and C. Four inkjet heads 1 that respectively eject magenta ink, cyan ink, yellow ink, and black ink and a conveyance unit 20 are arranged in the space A. A sheet feed unit 1*b* removably attached to the housing 1*a* is disposed in the space B, and an ink tank unit 1*c* is disposed in the space C. In the embodiment, a sub-scan direction is a direction parallel to the conveyance direction in which a sheet P is conveyed by means of a conveyance unit 20. A main scan direction is a direction that is orthogonal to the sub-scan direction and that is aligned to a horizontal plane.

A sheet conveyance path along which the sheet P is to be conveyed from the sheet feed unit 1*b* to the sheet output section 31 is formed in the inkjet printer 101 (as designated by an arrow of medium width shown in FIG. 1). The sheet feed unit 1*b* includes a sheet feed tray 23 capable of housing a plurality of sheets P and a sheet feed roller 25 attached to the sheet feed tray 23. The sheet feed roller 25 feeds the topmost sheet P among a plurality of sheets P stocked in a piled manner in the sheet feed tray 23. The sheet P fed by the sheet feed roller 25 is fed to the conveyance unit 20 while being guided by guides 27*a* and 27*b* and nipped between a pair of feed rollers 26.

The conveyance unit 20 includes two belt rollers 6 and 7; an endless conveyance belt 8 wrapped around the rollers so as to extend between the rollers 6 and 7; and a tension roller 10. The tension roller 10 is downwardly forced while remaining in contact with an internal peripheral surface of a lower loop of the conveyance belt 8, to thus impart tension to the conveyance belt 8. The belt roller 7 is a drive roller and rotated in a clockwise direction in FIG. 1 when imparted with drive force from a conveyance motor M through two gears. The belt roller 6 is a driven roller and rotated by rotation of the belt roller 7 in the clockwise direction in FIG. 1 along with travel of the conveyance belt 8.

An outer peripheral surface 8*a* of the conveyance belt 8 is subjected to silicon treatment and exhibits adhesiveness. A nip roller 4 is disposed at a position along the sheet conveyance path so as to oppose the belt roller 6 with the conveyance belt 8 sandwiched therebetween. The nip roller 4 presses the sheet P fed out of the sheet feed unit 1*b* against the outer peripheral surface 8*a* of the conveyance belt 8. The sheet P pressed against the outer peripheral surface 8*a* is conveyed in a rightward direction in FIG. 1 while held on the outer peripheral surface 8*a* by means of adhesiveness of the outer peripheral surface.

A separation plate 5 is disposed at a position on the sheet conveyance path where the separation plate opposes the belt roller 7 with the conveyance belt 8 sandwiched therebetween. The separation plate 5 separates the sheet P from the outer peripheral surface 8*a*. The thus-separated sheet P is conveyed while guided by guides 29*a* and 29*b* and nipped by two feed roller pairs 28 and output to the sheet output section 31 from an opening 30 formed in the upper portion of the housing 1*a*.

Four inkjet heads 1 are supported by the housing 1*a* through a frame 3. The four inkjet heads 1 extend along the main scan direction and are arranged in parallel to each other along the sub-san direction. The inkjet printer 101 is a line-type color inkjet printer in which an ejection area extending in the main scan direction is formed. A lower surface of each of the inkjet heads 1 is an ejection surface 2*a* through which ink droplets are ejected.

A platen 19 is arranged in the loop of the conveyance belt 8 and is opposed to the four inkjet heads 1. An upper surface of the platen 19 remains in contact with an internal peripheral surface of an upper loop of the conveyance belt 8 and supports the conveyance belt 8 from its inner peripheral side. The outer peripheral surface 8*a* of the upper loop of the conveyance belt 8 is opposed the lower surfaces of the inkjet heads 1, namely, the ejection surfaces 2*a*, in parallel to each other, whereby clearance of predetermined interval suitable for producing an image is created. The clearance makes up a portion of the sheet conveyance path. When the sheet P conveyed by the conveyance belt 8 passes by positions located immediately below the respective heads 1, respective colors of ink are sequentially ejected toward an upper surface of the sheet P from the respective heads 1, whereupon a desired color image is produced on the sheet P.

The respective inkjet heads 1 are connected to respective ink tanks 49 set in the ink tank unit 1*c* provided in the space C. The four ink tanks 49 store ink to be ejected by the corresponding ink jet heads 1, respectively. Ink is supplied from each of the ink tanks 49 to the corresponding inkjet head 1 through a tube (not shown), or the like.

The inkjet heads 1 are now described in detail by reference to FIGS. 2 and 3. A lower housing 87 is omitted from FIG. 3.

Figure 2:
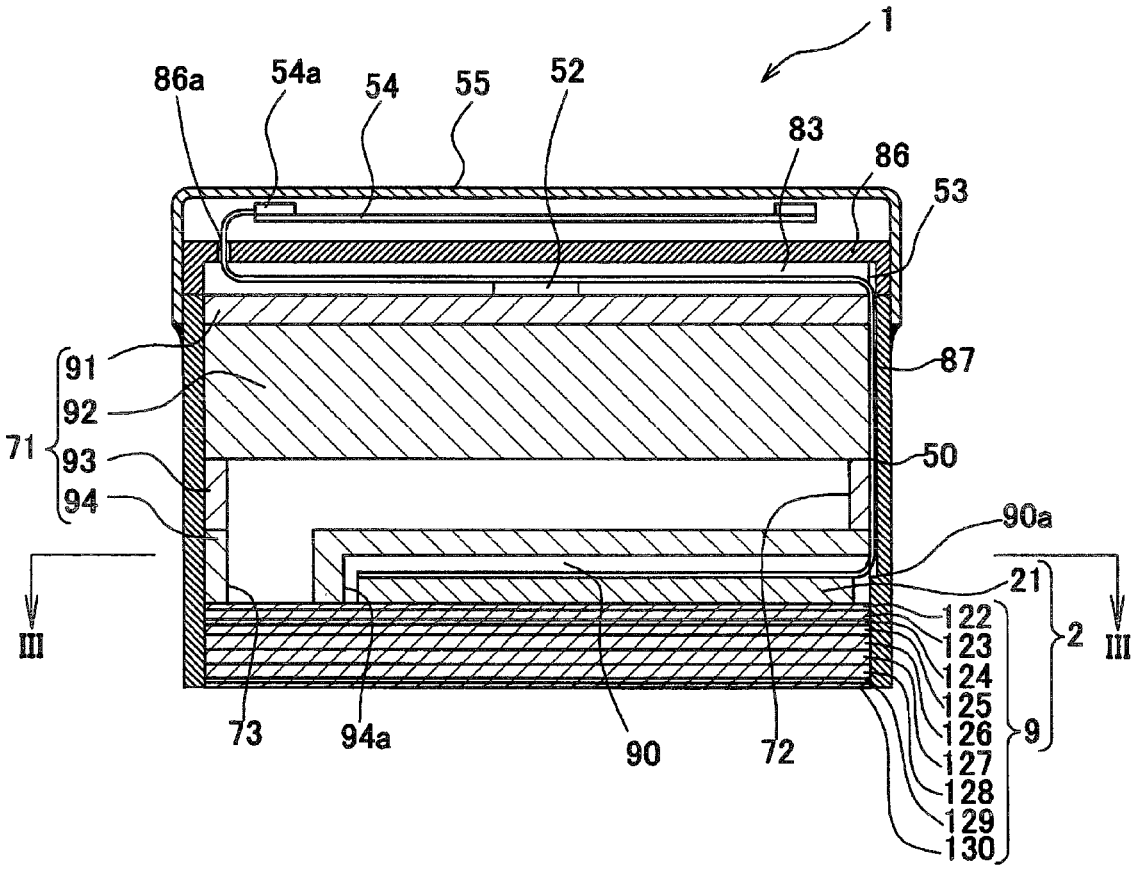
FIG. 2 is a cross sectional view of the inkjet head shown in FIG. 1 taken along its widthwise direction.

As shown in FIG. 2, each of the inkjet heads 1 includes a reservoir unit 71; a head main body 2 including a flow channel unit 9 and an actuator unit 21; and a COF (Chip On Film: a flat flexible substrate) 50 that is connected at its one end to the actuator unit 21 and that is equipped with a driver IC 52; and a control substrate 54 to which the other end of the COF 50 is connected. The inkjet head 1 includes the reservoir unit 71; an upper housing 86 and the lower housing 87 that make up a box surrounding the flow channel unit 9; and a head cover 55 that encloses the control substrate 54 at a position above the upper housing 86.

The reservoir unit 71 is a flow channel formation member that is fixed to an upper surface of the head main body 2 and that supplies the head main body 2 with ink. The reservoir unit 71 is a multilayered substance formed by stacking four mutually positioned plates 91 to 94. An unillustrated ink inflow channel, the ink reservoir 72, and ten ink outflow channels 73 are formed in the reservoir unit so as to mutually communicate with each other. Only one of the ink outflow channels 73 is shown in FIG. 2. The ink inflow channel is a channel into which ink flows from the ink tank 49. The ink reservoir 72 temporarily stores an inflow of ink from the ink inflow channel. The ink outflow channel 73 is a flow channel through which ink flows from the ink reservoir 72 and that is in mutual communication with an ink supply port 105*b* formed in an upper surface of the flow channel unit 9. Ink from the ink tank 49 flows into the ink reservoir 72 through the ink inflow channel, passes through the ink outflow channel 73, and is supplied from the ink supply port 105*b* to the flow channel unit 9.

An indentation 94*a* is formed in a lower surface of the plate 94. The indentation 94 creates clearance 90 between the lower surface of the plate and an upper surface of the flow channel unit 9. The four actuator units 21 on the flow channel unit 9 are arranged at equal intervals in the clearance 90 along the longitudinal direction of the flow channel unit 9. In a side surface of the multilayered substance, four openings 90*a* of the clearance 90 are formed at equal intervals in a staggered pattern and along the longitudinal direction of the reservoir unit 71.

Protuberances (areas other than the indentation 94*a*) on the lower surface of the plate 94 are adhered to the flow channel unit 9. The ink outflow channels 73 are formed in the respective protuberances.

A neighborhood of one end of the individual COF 50 is connected to an upper surface of the corresponding actuator unit 21. The COF 50 extends from the upper surface of the actuator unit 21 in a horizontal direction and passes through the opening 90*a*. The COF thus passed through the opening is then curved and bent at substantially right angles in an upward direction. The thus-bent COF passes through a cutout 53 formed in an interior wall surface of the upper housing 86 and the lower housing 87 and is pulled to a position above the reservoir unit 71. The COF 50 further extends in a leftward direction in FIG. 2 at a position above the reservoir unit 71 and pulled to a position above the upper housing 86 through a slit 86*a* formed in the upper housing 86. The other end of the COF 50 is connected to the corresponding control substrate 54 through a connector 54*a* at a position above the upper housing 86. A driver IC 52 is mounted at an arbitrary position on the COF 50. The driver IC 52 is affixed to the upper surface of the reservoir unit 71 and thermally coupled to the reservoir unit 71. Heat given off by the driver IC 52 thereby propagates to the reservoir unit 71, whereupon the driver IC 52 is cooled. On the other hand, ink in the reservoir unit 71 is heated, to thus hinder an increase in viscosity of ink.

The control substrate 54 is placed at a position above the upper housing 86 and controls actuation of the actuator unit 21 through the driver IC 52 of the COF 50. The driver IC 52 is for generating a drive signal for actuating the actuator unit 21.

The head main body 2 is now described with reference to FIGS. 3 and 4. Pressure chambers 110, apertures 112, and ejection ports 108, which are located beneath the actuator unit 21 and which are to be drawn in broken lines, are drawn in solid lines in FIG. 4 for the sake of explanation.

Figure 3:
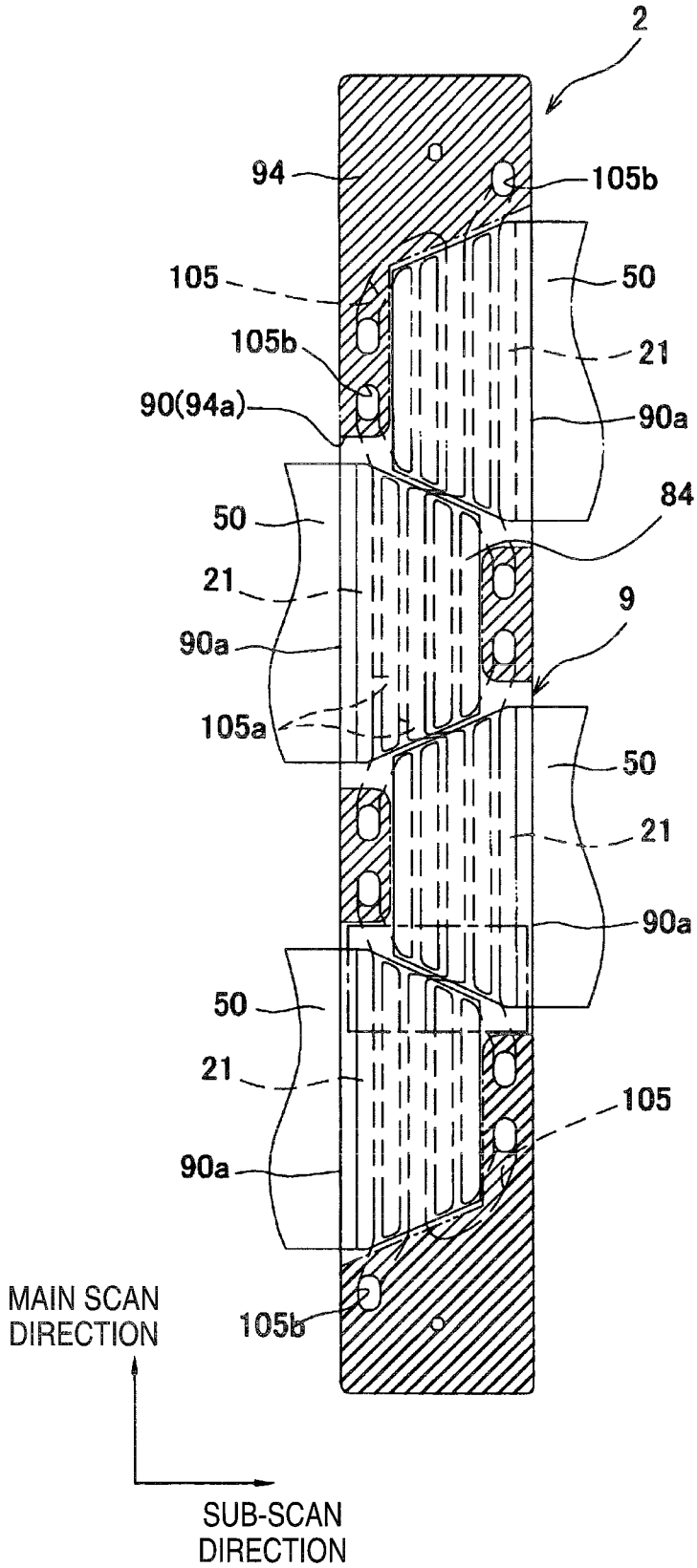
FIG. 3 is a cross sectional view taken along line shown in FIG. 2.
Figure 4:
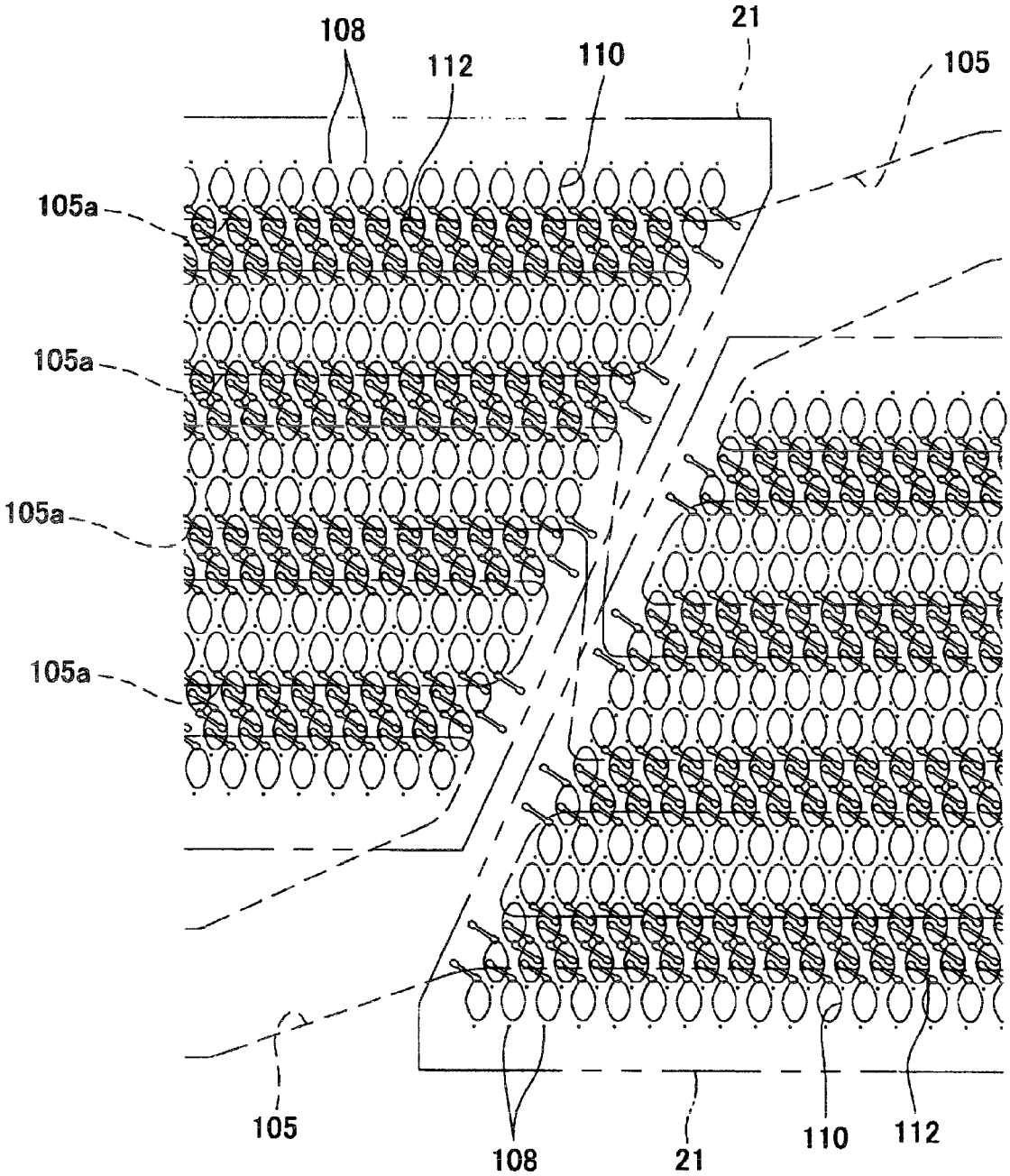
FIG. 4 is an enlarged view of an area enclosed by a dashed line shown in FIG. 3.

As shown in FIG. 3, the head main body 2 is a multilayered substance in which the four actuator units 21 are fixed to the upper surface 9*a* of the flow channel unit 9. As shown in FIGS. 3 and 4, ink flow channels, including the pressure chambers 110, are formed in the flow channel unit 9. Each of the actuator units 21 includes a plurality of actuators assigned to the respective pressure chambers 110 and has a function of selectively imparting ejection energy to ink stored in the respective pressure chambers 110.

The flow channel unit 9 assumes the shape of a rectangular parallelepiped having substantially the same planar shape as that of the plate 94 of the reservoir unit 71. A total of ten ink supply ports 105*b* are formed in the upper surface 9*a* of the flow channel unit 9 in correspondence with the ink outflow channels 73 of the reservoir unit 71 (see FIG. 2). As shown in FIG. 3, there are formed in the flow channel unit 9 a manifold flow channel 105 remaining in mutual communication with the ink supply ports 105*b*, a sub-manifold 105*a* branched off from the manifold flow channel 105, and a plurality of individual ink flow channels 132 branched off from the sub-manifold flow channel 105*a*. As shown in FIG. 1, the ejection surfaces 2*a* are formed on a lower surface of the flow channel unit 9, and as shown in FIG. 4, the plurality of ejection ports 108 are arranged in the ejection surfaces in a matrix pattern. The plurality of pressure chambers 110 are also arranged in a matrix pattern in the upper surface 9*a* of the flow channel unit 9 (i.e., the surface to which the actuator units 21 are fixed). The ejection ports 108 are arranged, along the main scan direction, at an interval of 600 dpi that is a resolution achieved in the main scan direction.

In the embodiment, sixteen rows of the pressure chambers 110 that are equally spaced along the longitudinal direction of the flow channel unit 9 are arranged in parallel to each other along a widthwise direction. The number of pressure chambers 110 included in each of the rows of pressure chambers becomes gradually smaller from a long side (a lower bottom side) to a short side (an upper bottom side) in correspondence with the outer shape (a trapezoidal shape) of the actuator unit 21 to be described later. The ejection ports 108 are also arranged correspondingly.

The flow channel unit 9 is a multilayered substance made by mutually positioning a plurality of metal plates made of stainless steel. Formed in the flow channel unit 9 are a plurality of individual ink flow channels 132 that extend from the manifold flow channel 105 to the sub-manifold flow channels 105*a* and from exits of the sub-manifold flow channels 105*a* to the ejection ports 108 through the pressure chambers 110.

Ink flow in the flow channel unit 9 is now described. As shown in FIGS. 3 and 4, the ink supplied from the reservoir unit 71 into the flow channel unit 9 through the ink supply port 105*b* is distributed from the manifold flow channel 105 to the sub-manifold flow channels 105*a*. The ink in the sub-manifold flow channels 105*a* flows into the individual ink flow channels and reaches the ejection ports 108 through the pressure chambers 110.

The actuator units 21 are unimorph actuators. The unimorph actuator is made up of lead zirconate titanate (PZT)-based piezoelectric c sheet made of ceramic exhibiting ferroelectricity. Upon receipt of an input of a drive signal, the actuator unit 21 selectively imparts pressure (ejection energy) to the ink in a target pressure chamber 110, thereby ejecting an ink droplet from the corresponding ejection port 108.

Figure 5:
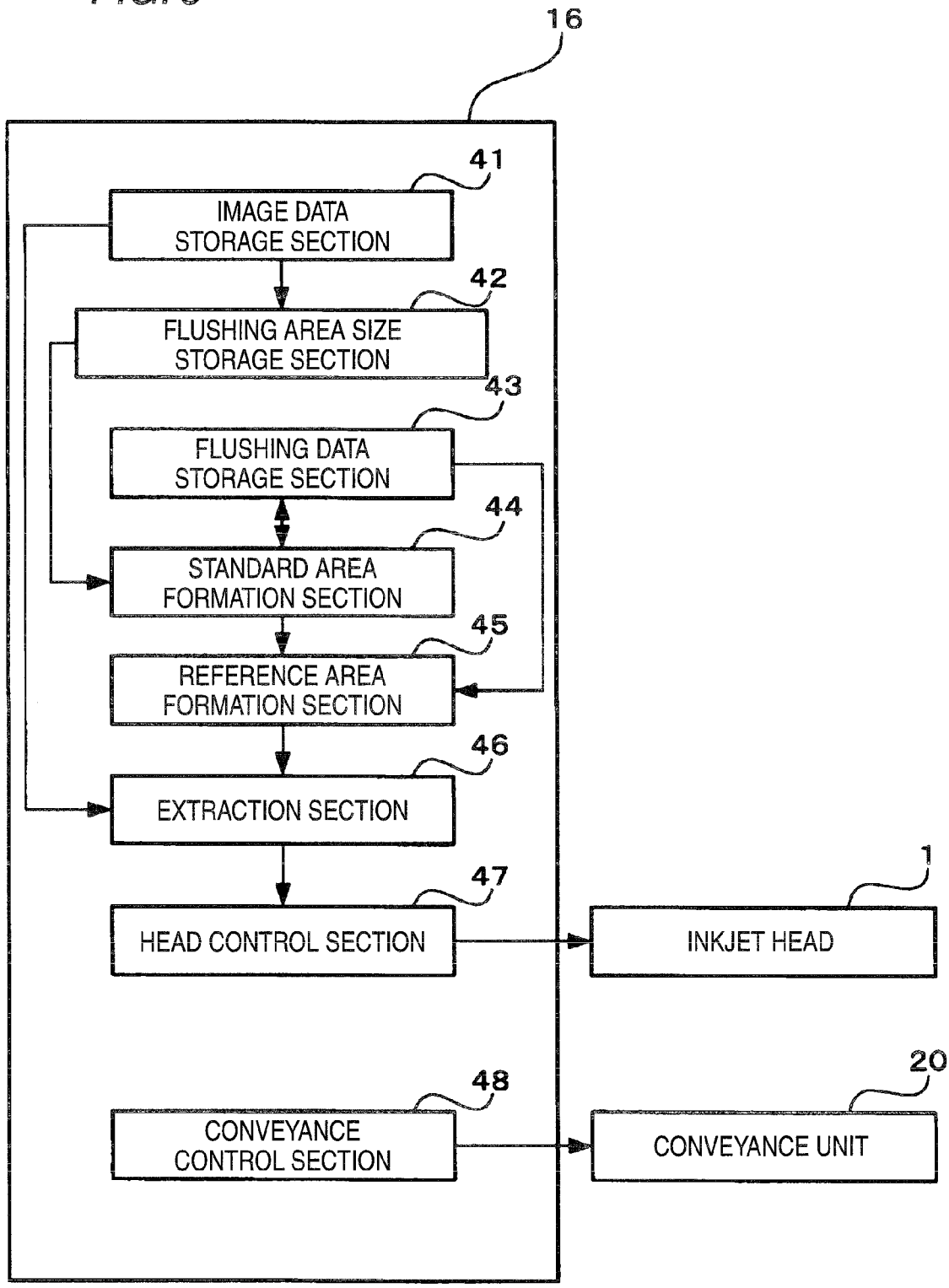
FIG. 5 is a functional block diagram of a controller shown in FIG. 1.

The controller 16 is now described by reference to FIG. 5. The controller 16 includes a CPU (Central Processing Unit); EEPROM (Electrically Erasable and Programmable Read Only Memory) that rewritably stores a program to be executed by the CPU and data used for the program; and RAM (Random Access Memory) that temporarily stores data at the time of execution of the program. Respective operation parts making up the controller 16 are built as a result of these hardware parts and software in the EEPROM acting synergistically. As shown in FIG. 5, the controller 16 controls the entirety of the inkjet printer 101 and includes an image data storage section 41, a flushing area size storage section 42, a flushing data storage section 43, a standard area formation section 44, a reference area formation section 45, an extraction section 46, a head control section 47, and a conveyance control section 48.

The conveyance control section 48 controls a conveyance motor M of the conveyance unit 20 such that the sheet P is conveyed along a conveyance direction.

The image data storage section 41 stores image data pertaining to an image to be printed in a print area defined on the sheet P. The image data allocate volumes of ink droplets used for producing respective image dots, which make up an image, to the respective ejection ports 108 of the respective inkjet heads 1 at every print cycle. Ink droplets to be ejected from the ejection ports 108 in the present embodiment correspond to any selected from ink droplets having three types of volumes of ink droplets (large ink droplets, medium ink droplets, and small ink droplets). The print cycle corresponds to a period of time required to convey the sheet P only over a unit distance commensurate with a print resolution achieved in the conveyance direction.

The image data represent positions of virtual pixels (spatial elements), which are associated with image dots to be produced at intervals commensurate with a resolution for the main scan direction (a first resolution: a distance between the ejection ports 108 achieved in the main scan direction) and a resolution for the conveyance direction (a second resolution) with respect to the main scan direction and the conveyance direction, on a virtual sheet P' (see FIG. 10) that shows the print area of the sheet P in a data space. The virtual sheet P' is formed as a result of a plurality of virtual pixels being arranged in a matrix pattern within a two-dimensional space defined by an axis extending along the main scan direction and another axis extending along the conveyance direction. A distance on the virtual sheet P' between virtual pixels achieved in the conveyance direction is a distance on the sheet P commensurate with the resolution for the conveyance direction. A distance on the virtual sheet P' between virtual pixels achieved in the main scan direction is a distance on the sheet P commensurate with the resolution for the main scan direction. The respective virtual pixels on the virtual sheet P' are located at positions associated with any of the ejection ports 108 of the respective inkjet heads 1 with respect to the main scan direction.

Figure 10:
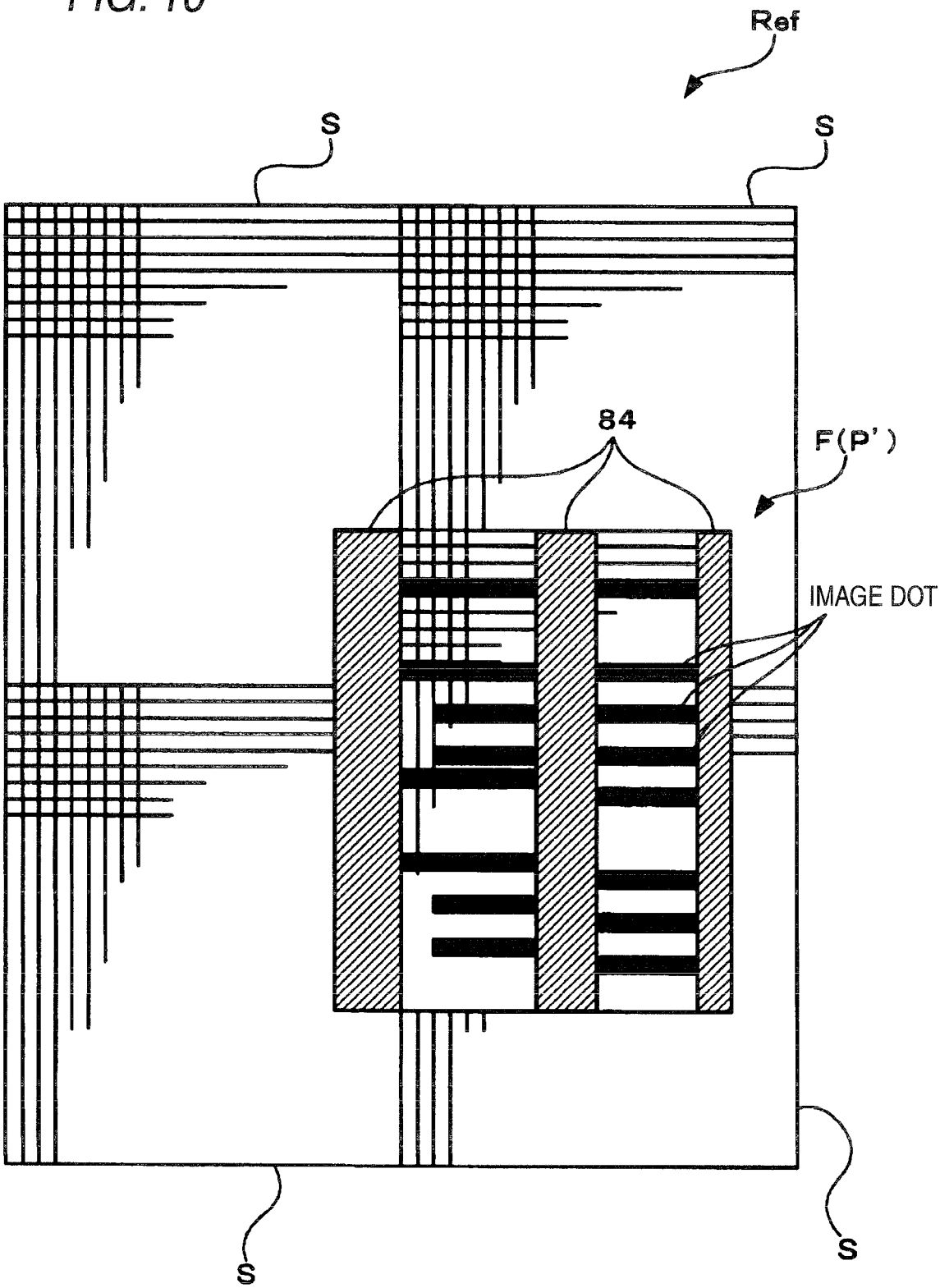
FIG. 10 is a view showing operation of an extraction section shown in FIG. 5.

A flushing area overlapping the print area is defined on the sheet P. The flushing area is an area where flushing dots are created through flushing (preliminary ejection) processing for ejecting ink before ink in the ejection ports 108 becomes degenerated. The flushing area is a range that occupies the entirety of the print area in the main scan direction and that occupies at least a portion of the print area in the conveyance direction. The flushing area can be arbitrarily determined by the user. In the present embodiment, the flushing area is assumed to match the print area of the sheet P. As shown in FIG. 10, a virtual flushing area F is a virtual area that depicts the flushing area in the data space. The virtual flushing area F is made up of a plurality of virtual pixels arranged in a matrix pattern in both the conveyance direction and the main scan direction.

In the embodiment, a length of the virtual flashing area F in the main scan direction may correspond to a length of an area, in which the plurality of ejection ports 108 are arranged, in the main scan direction.

The flushing area size storage section 42 stores the number of virtual pixels in the virtual flushing area F corresponding to the flushing area in the conveyance direction. As mentioned previously, the flushing area is determined in the form of the area that occupies at least a portion of the print area of the sheet P in the conveyance direction. Therefore, the number of virtual pixels in the virtual flushing area F in the conveyance direction is equal to or smaller than a quotient determined by dividing the length of the print area achieved in the conveyance direction by a unit distance commensurate with the resolution for the direction of the conveyance. A degree of freedom of setting of a data size pertaining to flushing is thereby increased, so that a storage capacity can be reduced. In the present embodiment, the flushing area matches the print area. The flushing area size storage section 42 stores, as the number of pixels, a quotient determined by dividing the length of the print area achieved in the conveyance direction by the unit distance commensurate with the resolution for the conveyance direction.

The flushing data storage section 43 stores flushing data for each color of ink used. Flushing data include data that show four base flushing patterns in correspondence with colors of ink. Each of the base flushing patterns is a layout pattern for a plurality of flushing candidate pixels achieved in a base area S0. The base flushing pattern corresponds to a layout of virtual pixels corresponding to positions where flushing dots can be produced.

The base area S0 is a virtual area made as a result of a plurality of virtual pixels being arranged in a matrix pattern. The base area S0 is made up of virtual pixels that are equal in number to the virtual flushing area F in the main scan direction and at least one flushing candidate pixel selected from the respective rows of virtual pixels in the conveyance direction. As will be described later, the standard area S is formed from the base area S0, and the base area S0 can be said to be a unit virtual area where flushing candidate pixels are arranged in a flushing dot arrangement pattern. The flushing data storage section 43 stores the data pertaining to the base area S0, and the data include information about the number of virtual pixels making up the base area S0 (achieved in both the main scan direction and the conveyance direction) and a unit arrangement location for a flushing candidate pixel in the base area S0. Detailed explanations are given to the flushing data stored in the flushing data storage section 43 by further referring to FIGS. 6 and 7.

Figure 6:
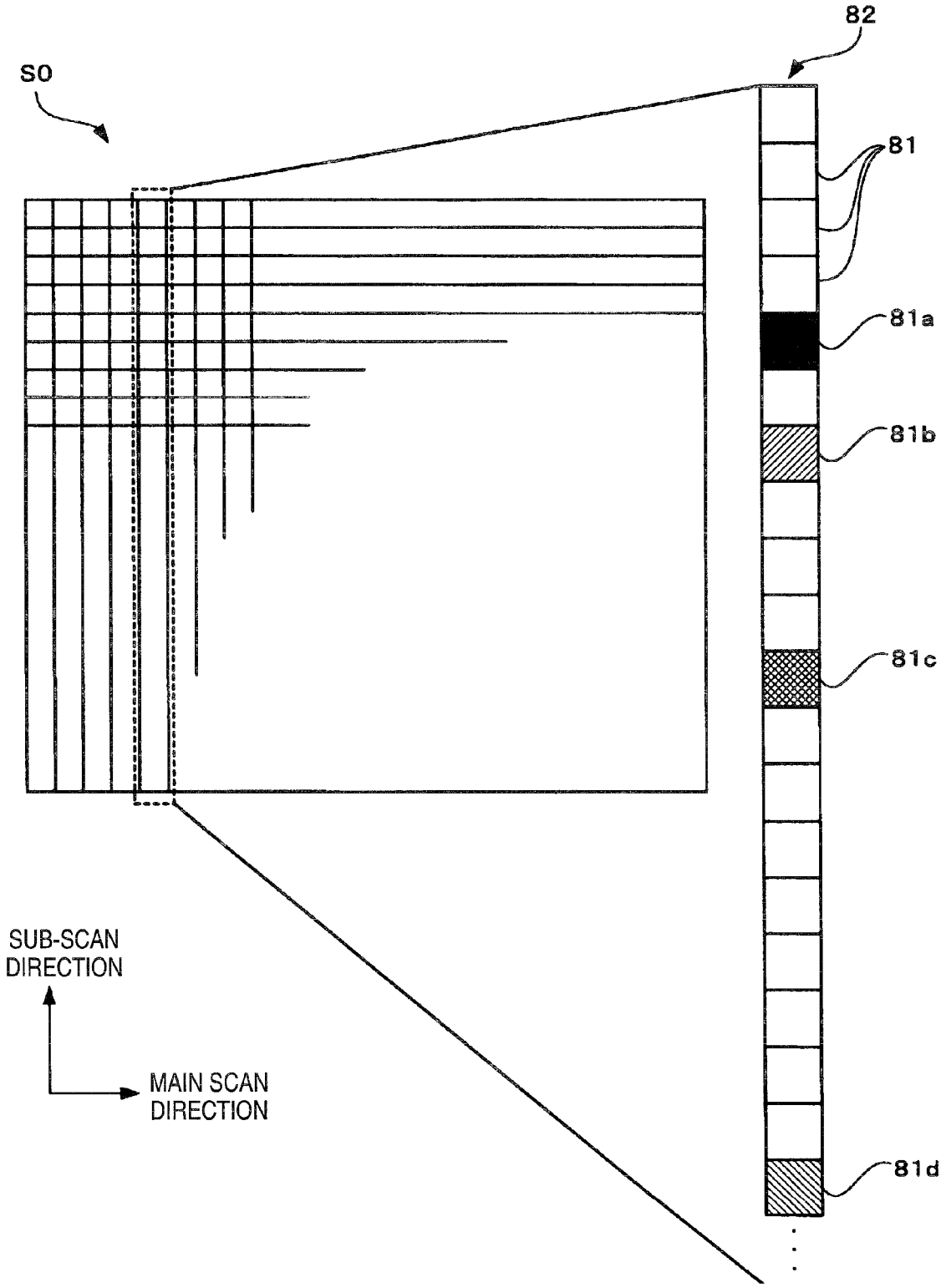
FIG. 6 is a schematic view of a bottom area representing a flushing pattern stored in a flushing data storage section shown in FIG. 5.

As shown in FIG. 6, the base area S0 is made up of a 4961×3508 matrix of virtual pixels 81. The number of the virtual pixels 81 arranged in the base area S0 along the main scan direction; namely, 4961, is a number equal to a result of the length of the print area of the sheet P in the main scan direction being divided by a unit distance (about 42 micrometers) commensurate with a resolution of 600 dpi for the main scan direction. The number of the virtual pixels 81 arranged in the base area S0 along the conveyance direction; namely, 3508, is a number equal to a result of the length of the print area of the sheet P in the conveyance direction being divided by a unit distance (about 84 micrometers) commensurate with a resolution of 300 dpi for the conveyance direction. As mentioned above, in the present embodiment, the base area S0 is a virtual area specified by the lowest resolution of 300 dpi (which will be described later) at least with respect to the conveyance direction. In the base area S0, 3508 virtual pixels 81 arranged along the conveyance direction make up one virtual pixel row 82, and 4961 virtual pixel rows 82 arranged along the main scan direction make up the base area S0.

The inkjet printer 101 takes a resolution of 300 dpi as the lowest resolution for the conveyance direction and can print an image at any one of four resolutions that increase in steps of 100 dpi. A resolution of 600 dpi is the highest resolution for the conveyance direction at which the inkjet printer 101 can produce a print. A distance between adjacent virtual pixels 81 in the base area S0 acquired with respect to the conveyance direction is equivalent to the unit distance commensurate with the resolution for the conveyance direction. A distance between adjacent virtual pixels 81 in the base area S0 acquired with respect to the main scan direction is equivalent to the unit distance commensurate with the resolution for the main scan direction.

The virtual pixels 81 that are flushing candidate pixels are depicted by reference numerals 81*a* to 81*d*, to thus be distinguished from virtual pixels that are not the flushing candidate pixels. The virtual pixel 81*a* represents a flushing candidate pixel pertaining to a black flushing pattern. The virtual pixel 81*b* represents a flushing candidate pixel pertaining to a magenta flushing pattern. The virtual pixel 81*c* represents a flushing candidate pixel pertaining to a cyan flushing pattern. The virtual pixel 81*d* represents a flushing candidate pixel pertaining to a yellow flushing pattern.

One virtual pixel row 82 in the base area S0 is brought in correspondence with one ejection port 108. Each of the virtual pixel rows 82 includes four virtual pixels 81*a* to 81*d* that are flushing candidate pixels. In each of the virtual pixel rows 82, the virtual pixels 81*a* to 81*d* are placed at this time at mutually-different positions.

The present embodiment provides a configuration in which the flushing area matches the print area as mentioned above. The number of virtual pixels 81 (=3508) arranged in the base area S0 along the conveyance direction is determined from the lowest resolution of 300 dpi at which the printer can produce a print. The flushing data storage area 43 stores the number of virtual pixels 81 arranged along the conveyance direction; namely, 3508, as the number of the virtual pixels 81 arranged in the base area S0 along the conveyance direction.

Figure 7:
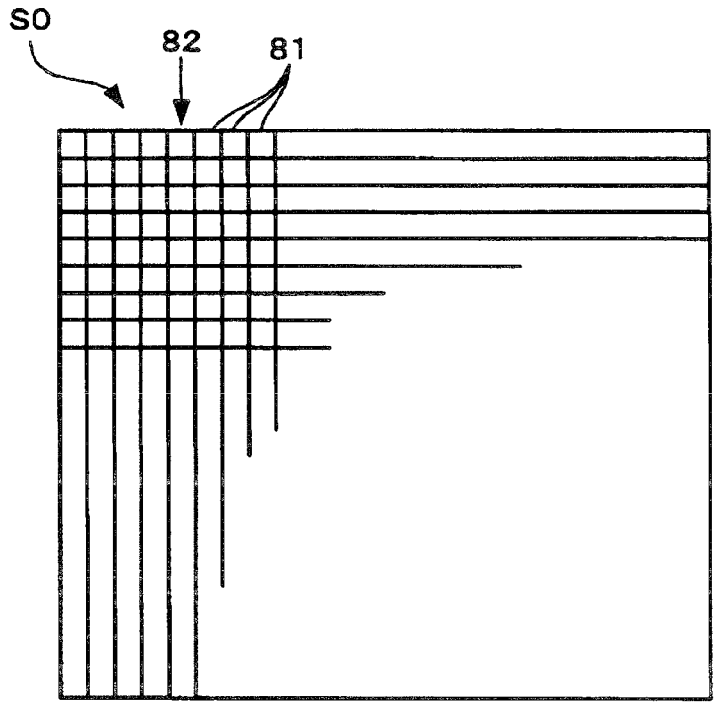
FIGS. 7A and 7B are schematic views of a bottom area and a standard area shown in FIG. 6.
Figure 7:
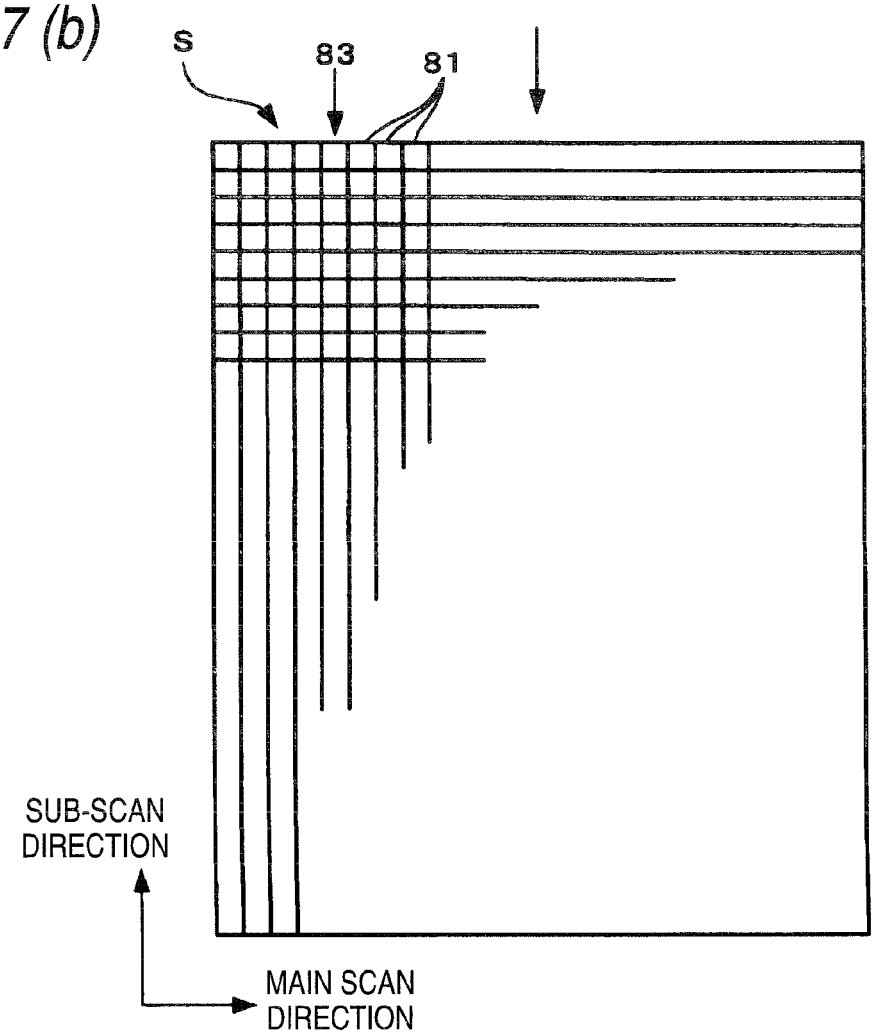
Figure 8:
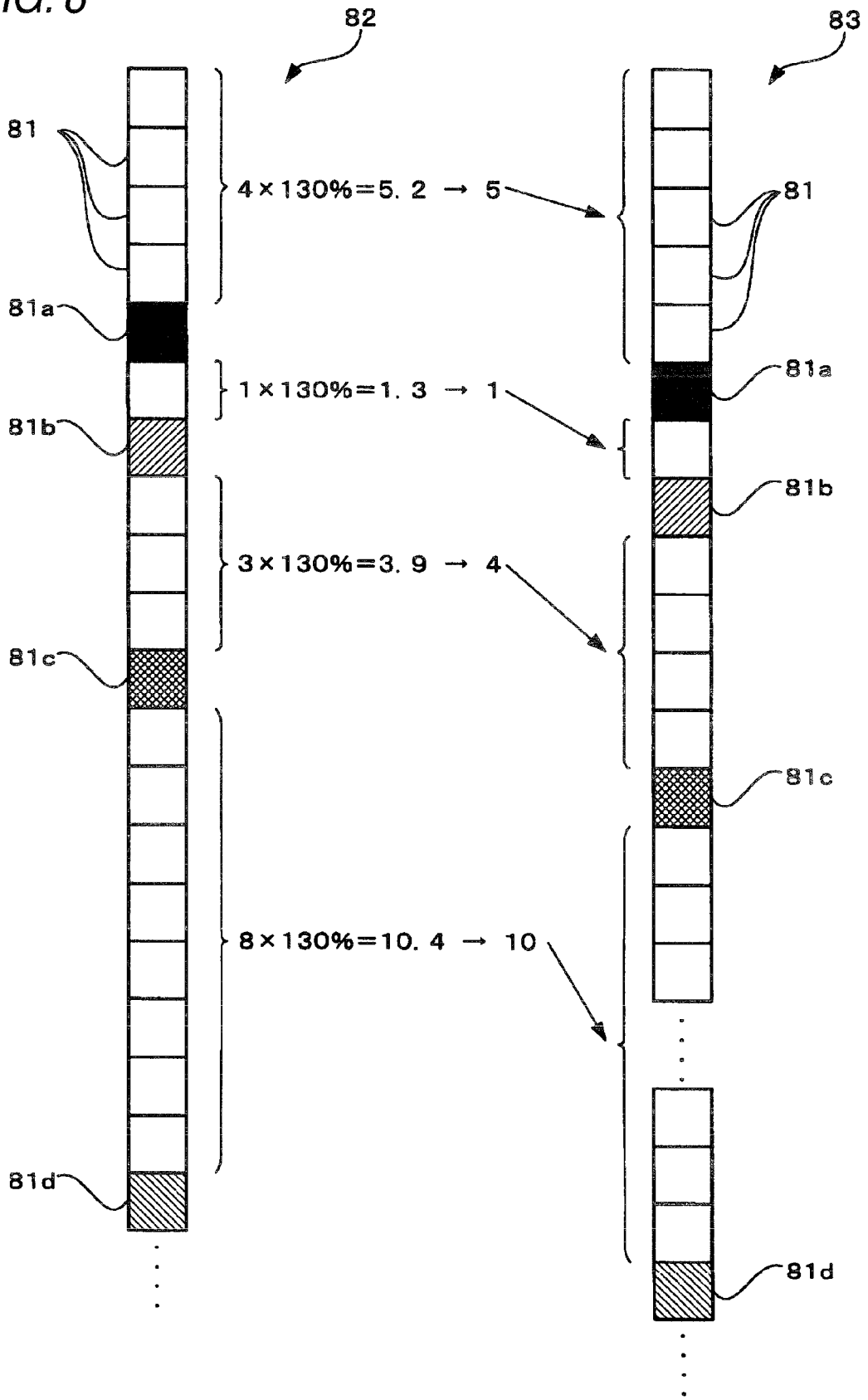
FIG. 8 is a partially enlarged view of the bottom area and the standard area Shown in FIGS. 7A and 7B.

As shown in FIGS. 7 and 8, the standard area formation section 44 produces a standard area S from the number of virtual pixels 81 arranged in the virtual flushing area F along the conveyance direction stored in the flushing area size storage section 42, by enlarging the base area S0 in the conveyance direction. The base area S0 is enlarged at this time in such a way that the number of virtual pixels 81 arranged in the base area S0 matches the virtual flushing area F with respect to the conveyance direction.

When the resolution required by image data is now assumed to be 300 dpi, the number of virtual pixels 81 arranged in the virtual flushing area F along the conveyance direction is equal to the number of virtual pixels 81 arranged in the base area S0 along the conveyance direction. Accordingly, the standard area formation section 44 sets, as the standard area S, the base area S0 where 4961 virtual pixels 81 are arranged along the main scan direction and where 3508 virtual pixels 81 are arranged along the conveyance direction. In this case, the standard area S has the same arrangement pattern as that of the base area S0 in connection with the virtual pixels 81 and the flushing candidate pixels.

When the resolution required by image data is 600 dpi, the standard area formation section 44 first calculates a scale-up factor of 200% that is a ratio of 600 dpi to 300 dpi. On the basis of the base flushing pattern, the standard area formation section 44 doubles the number of virtual pixels in each of the virtual pixel rows of the base area S0 except the flushing candidate pixels [processing for increasing the number of continual virtual pixel groups (which will be described later)]. Further, the standard area formation section 44 adds virtual pixels, which are equal in number to the flushing candidate pixels included in the virtual pixel row and which are not flushing candidate pixels, to each of the virtual pixel rows (processing for enlarging flushing candidate pixels themselves). Virtual pixels to be added are arranged; for instance, in such a way that each of the flushing candidate pixels is followed by one virtual pixel. When the scale-up factor is not an integral multiple as mentioned in connection with the foregoing embodiment, the number of virtual pixels included in the virtual pixel row is adjusted so as to obtain an integral multiple closest to a product resultant from multiplication of the scale-up factor.

Specifically, the standard area formation section 44 calculates a scale-up factor (130% in FIGS. 7 and 8) that is a ratio of a resolution for the virtual flushing area F achieved in the conveyance direction to a resolution for the base area S0 achieved in the conveyance direction (the lowest resolution achieved in the conveyance direction). In relation to each of the virtual pixel rows 82 of the base area S0 in the conveyance direction, the standard area formation section 44 multiplies, by the scale-up factor, the number of continual virtual pixels 81 in the virtual pixel group consisting of one or a plurality of virtual pixels 81 that are defined by the virtual pixels 81*a* to 81*d* corresponding to flushing candidate pixels and that are not flushing candidate pixels, thereby calculating a new number of continual virtual pixels 81 in each of the virtual pixel groups. An integral closest to a product determined by multiplying the number of continual virtual pixels 81 by the scale-up factor is taken as a new number of continual virtual pixels 81. The standard area formation section 44 inserts one or a plurality of virtual pixels 81 into a virtual pixel group in each of the virtual pixel row 82 in such a way that the calculated number of continual virtual pixels 81 that are not the flushing candidate pixels comes to a newly calculated number of continual virtual pixels, thereby forming the standard area S. The thus-formed standard area S is stored in the flushing data storage section 43. Thus, the flushing data storage section 43 stores flushing data including four flushing patterns pertaining to the standard area S.

For instance, when four virtual pixels 81 are adjacently arranged in the virtual pixel row 82 as shown in FIG. 8, we have 4×130%=5.2; hence, an integer closest to the product is five. Therefore, one virtual pixel 81 is inserted into the virtual pixel group including four virtual pixels 81. When only one virtual pixel 81 is arranged in the virtual pixel row 82, we have 1×130%=1.3, and an integer closest to the product is one. Therefore, the virtual pixel 81 is not newly inserted in this case. When three virtual pixels 81 are arranged adjacently to each other, we have 3×130%=3.9, and an integer closest to the product is four. Therefore, one virtual pixel 81 is inserted into the virtual pixel group including the three virtual pixels 81. When eight virtual pixels 81 are arranged adjacently to each other, we have 8×130%=10.4, and an integer closest to the produce is 10. Therefore, two virtual pixels 81 are inserted into the virtual pixel group including eight virtual pixels 81. Even in this case, the standard area formation section 44 adds, to each of the virtual pixel group, virtual pixels that are equal in number to the flushing candidate pixels included in the virtual pixel row and that are not fluxing candidate pixels, as in the case where the scale-up factor is an integral multiple. The standard area formation section 44 finally brings the number of virtual pixels included in the virtual pixel row in agreement with the standard area S. Processing for increasing the number of continual virtual pixels and processing for enlarging flushing candidate pixels themselves have already been performed thus far. An excess or a deficiency of virtual pixels occurred at this time may also be collectively placed at the had of the virtual pixel row. Alternatively, the excess or deficiency of virtual pixels may also be placed at the end of the virtual pixel row. A flushing area matching the print area can be subjected to flushing processing.

Figure 9:
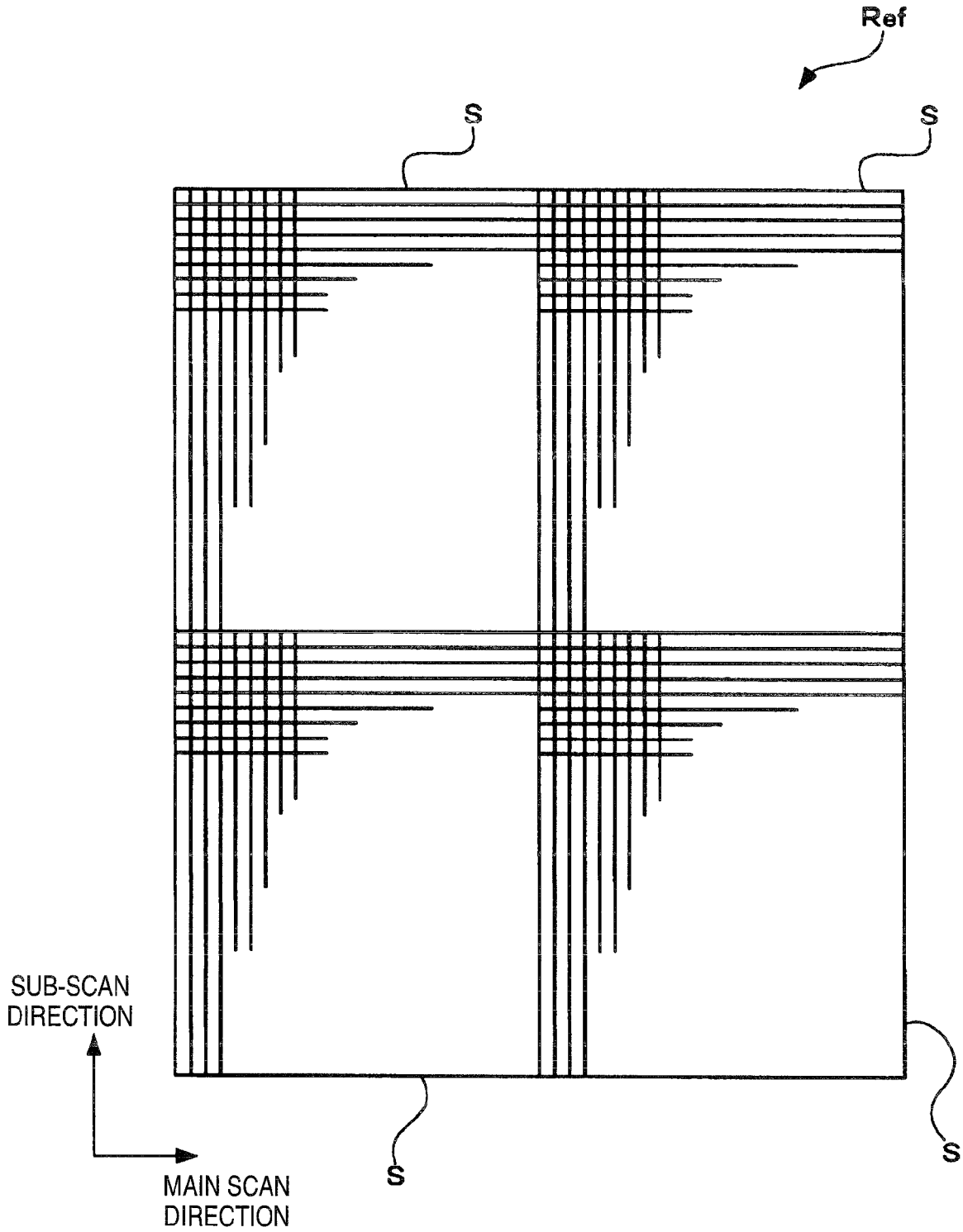
FIG. 9 is a schematic view of a reference area produced by a reference area generation section shown in FIG. 5.

The reference area formation section 45 forms a reference area Ref from the standard area S produced by the standard area formation section 44, as shown in FIG. 9. In the reference area Ref, two standard areas S are adjacently arranged in both the main scan direction and the conveyance direction. The expression "adjacently arranged" signifies that the outermost virtual pixels 81 of each of the adjacent standard areas S are spaced apart from each other by a distance commensurate with the resolution for the conveyance direction and the resolution for an orthogonal direction. The virtual pixels 81 of the standard area S are repeatedly arranged twice in the reference area Ref in a line along the main scan direction and in units equal in number to the virtual pixels 81 arranged in the standard area S along the main scan direction. The virtual pixels 81 of the standard area S are also repeatedly arranged twice in the reference area Ref in a line along the conveyance direction and in units equal in number to the virtual pixels 81 arranged in the standard area S along the conveyance direction. The reference area Ref is thus made up of 9922 (=4961×2) virtual pixel rows arranged in the main scan direction, each of which includes 7016 (=3508×2) virtual pixels 81 arranged in the conveyance direction.

The extraction section 46 extracts flushing candidate pixels (flushing pixels) used for producing flushing dots from flushing candidate pixels (the virtual pixels 81*a* to 81*d*) included in the reference area Ref formed by the reference area formation section 45.

Specifically, the extraction section 46 virtually arranges a virtual flushing area F at a randomly determined position in the reference area Ref in such a way that all pixels of the virtual flushing area F overlap the virtual pixels 81 of the reference area Ref. FIG. 10 shows a state of the reference area achieved at this time. When respective image dots are associated with any pixel rows arranged along the conveyance direction, the extraction section 46 selects, in the virtual flushing area F, virtual pixel rows 84 not associated with the image dots. In an area where overlaps with the selected virtual pixel rows 84 are achieved, the extraction section 46 extracts, as flushing pixels for the virtual flushing area F, pixels overlapping the flushing candidate pixels (the virtual pixels 81*a* to 81*d*) in the reference area Ref. In the virtual flushing area F, there are actually produced the virtual area made up of only the virtual pixel rows 84 not associated with the image dots corresponds to the flushing area where flushing dots. Each of the virtual pixel rows 84 includes four flushing pixels in correspondence with the respective virtual pixels 81*a* to 81*d*. The flushing data storage section 43 stores flushing data pertaining to an arrangement pattern of the flushing pixels achieved at this time as a flushing pattern.

The virtual flushing area F completely overlaps one standard area S or straddles two or four standard areas S within the reference area Ref. The reference area Ref is formed by arranging the four standard areas S so as to become adjacent to each other. Hence, even when the virtual flushing area F straddles two or four standard areas S, only one pixel overlapping any of the flushing candidate pixels (the virtual pixels 81*a* to 81*d*) is present in each of the virtual pixel rows arranged in the conveyance direction within the reference area Ref. Therefore, even when the virtual flushing area F is virtually arranged at any location within the reference area Ref, flushing pixels can be extracted from each of the virtual pixel rows 84 without fail.

The head control section 47 controls ejection of ink droplets from the ejection ports 108 of the inkjet head 1 through the control substrate 54. The head control section 47 determines whether or not a time elapsed since purging-and-wiping operation (which will be described later) was performed or flushing was performed has exceeded a predetermined time T. When determined that the elapsed time has not exceeded the predetermined time T, the head control section 47 controls ejection of ink droplets from the ejection ports 108 of the respective ink jet heads 1 in such a way that only image dots pertaining to image data stored in the image data storage section 41 are formed on the sheet P without formation of the flushing dots on the sheet P. The predetermined time T is a time that is shorter than a period of time during which speed of an ink droplet ejected from the ejection port 108 decreases from a reference speed to a predetermined percentage of the reference speed as a result of the ink stored in the ejection ports 108 being degraded by drying, or the like. The predetermined time T is set to a time that is shorter than a period of time during which a change in image quality is visibly recognized.

When determined that the elapsed time exceeds the predetermined time T, the head control section 47 produces a logical OR between image pixels relevant to the image dots included in image data and flushing pixels extracted by the extraction section 46 (ejection data that are a logical OR between image data and flushing data stored in the flushing data storage section 43). The head control section 47 controls ejection of ink droplets from the ejection ports 108 of the respective inkjet heads 1 in such a way that the image dots included in the logical OR (the ejection data) and flushing dots corresponding to the flushing pixels are formed on the sheet P conveyed to the conveyance unit 20. Ink droplets are ejected at least one from all of the ejection ports 108 of the respective inkjet heads 1 every time the predetermined time T elapses.

Figure 11:
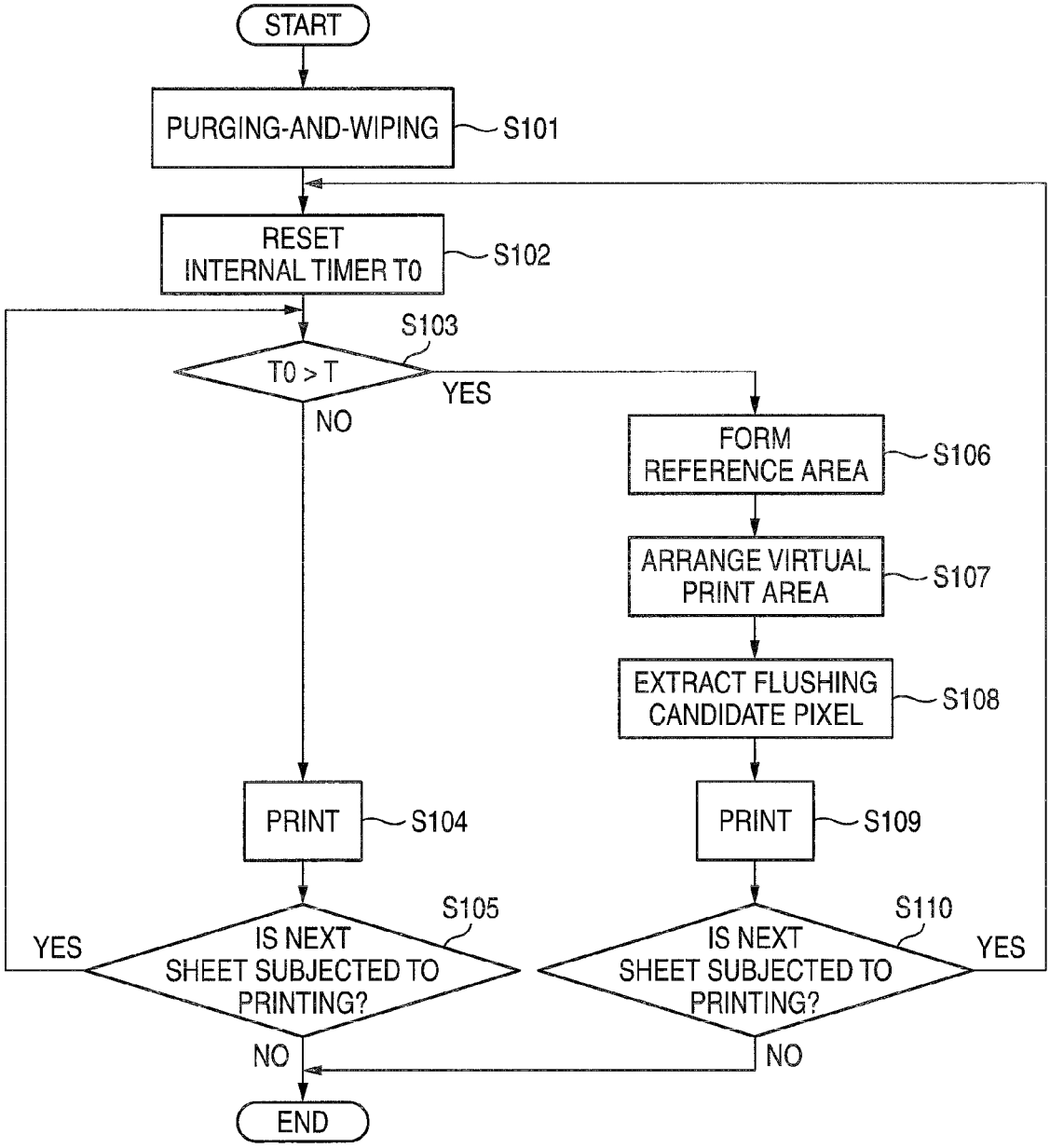
FIG. 11 is a flowchart showing operation procedures of a controller shown in FIG. 5.

Operation procedures of the controller 16 are now described by reference to FIG. 11. As shown in FIG. 11, upon receipt of a print start command from a host computer, the controller performs purging-and-wiping operation (S101). The purging-and-wiping operation means operation for forcefully supplying ink from an unillustrated ink supply pump to the respective inkjet heads 1, purging (ejecting) ink from the respective ejection ports 108, and wiping the ejection surfaces 2*a* by means of unillustrated wipers. It becomes possible to discharge ink having increased viscosity and impurities in the inkjet heads 1 to the outside by means of performing purging-and-wiping operation and to hold meniscuses formed in the ejection ports 108 in good condition. The head control section 47 resets an internal timer T0 (S102).

The head control section 47 subsequently determines whether or not the value of the internal timer T0 has exceeded the predetermined time T (S103). When determined that the value of the internal timer T0 has not exceeded the predetermined time T (NO in S103), the head control section 47 controls ejection of ink droplets from the ejection ports 108 of the ink jet head 1 in such a way that only image dots relevant to image data are produced on the sheet P (S104). When the sheet P has finished undergoing printing, the controller 16 determines whether or not to subject the next sheet P to printing (S105). When the next sheet P is subjected to printing (YES in S105), processing again proceeds to S103, where the next sheet P undergoes printing. When the next sheet P is not subjected to printing (NO in S105), processing pertaining to a flowchart shown in FIG. 11 is completed.

When the head control section 47 determines that the value of the internal timer T0 has exceeded the predetermined time T (YES in S103), the standard area formation section 44 forms the standard areas S from the base area S0, and the reference area formation section 45 forms the reference area Ref from the standard areas S (S106). The extraction section 46 randomly, virtually arranges the virtual flushing area F within the reference area Ref in such a way that all of the pixels of the virtual flushing area F overlap the virtual pixels 81 of the reference area Ref (S107). Further, when the respective image dots are associated with any of the pixel rows arranged along the conveyance direction within the virtual flushing area F, the extraction section 46 extracts, as flushing pixels relevant to the virtual flushing area F, the pixels overlapping the virtual pixels 81*a* to 81*d* of the reference area Ref corresponding to the flushing candidate pixels within the range where there are overlaps with the virtual pixel rows 84 not associated with the image dots (S108). The extraction section 46 generates flushing data at this time from the extracted flushing pixels and an arrangement pattern of the flushing pixels (the flushing pattern). Simultaneously, flushing data are stored in the flushing data storage section 43.

The head control section 47 controls ejection of ink droplets from the ejection ports 108 of the respective inkjet heads 1 in such a way that the image dots included in image data and flushing dots corresponding to flushing pixels extracted by the extraction section 46 are formed on the sheet P conveyed to the conveyance unit 20 (S109). The head control section 47 generates ejection data from the image data and flushing data in the flushing data storage section 43 and controls ejection of ink droplets in accordance with the ejection data. Ink droplets are ejected from all of the ejection ports 108 of the respective inkjet heads 1 at least once every time the predetermined time T elapses. When the sheet P has finished undergoing printing, the controller 16 determines whether to subject the next sheet P to printing (S110). When the next sheet P is subjected to printing (YES in S110), processing again proceeds to S102, and the internal timer TO is reset. Thus, the next sheet P is subjected to printing. When the next sheet P is not subjected to printing (NO in S110), processing pertaining to the flowchart shown in FIG. 11 is completed.

In the inkjet printer 101 of the present embodiment, the extraction section 46 can appropriately extract flushing pixels for the respective virtual pixel rows 84 even when the virtual flushing area F is virtually arranged at any location in the reference area Ref as mentioned above. Therefore, the virtual flushing area F is virtually arranged at a randomly-determined position within the reference area Ref, whereby it is possible to avoid formation of flushing dots at the same positions on all sheets P, to thus make the flushing dots less conspicuous. Positions of flushing dots can quickly be determined through processing involving small amount of arithmetic operation, such as virtually arranging the virtual flushing area F in the reference area Ref and extracting pixels overlapping the virtual pixels 81*a* to 81*d*, which are the flushing candidate pixels, in the reference area Ref as flushing pixels for the virtual flushing area F within the range where there are overlaps with the virtual pixel rows 84 not associated with the image dots for the virtual flushing area F.

Flushing data stored in the flushing data storage section 43 include four flushing patterns compliant with the respective inkjet heads 1. Four pixel rows for four flushing patterns placed at the same positions with respect to the main scan direction have the virtual pixels 81*a* to 81*d* that are flushing candidate pixels located at different positions with respect to the conveyance direction. When the flushing dots are formed, ink droplets ejected from the respective inkjet heads 1 do not arrive at the same locations in a record area on the sheet P. An increase in diameters of the flushing dots can thereby be prevented.

The extraction section 46 virtually arranges the virtual flushing area F at a randomly-determined position in the reference area Ref. Hence, positions where flushing dots are to be formed can readily be changed from one sheet P to another sheet P.

In addition, the reference area formation section 45 arranges two standard areas S adjacently to each other in both the main scan direction and the conveyance direction, thereby creating the reference area Ref. It is, therefore, possible to efficiently change positions where flushing dots are to be formed from one sheet P to another sheet P.

The standard area formation section 44 generates, from the base area S0 stored in the flushing data storage section 43, a plurality of standard areas S commensurate with mutually-different resolutions for the conveyance direction. It is not necessary to store the plurality of standard areas S in the flushing data storage section 43, so that the storage capacity of the flushing data storage section 43 can be made small. Further, the flushing data storage section 43 stores the base area S0 commensurate with the lowest resolution among the plurality of resolutions for the conveyance direction at which the inkjet printer 101 can produce a print, so that the storage capacity of the flushing data storage section 43 can be reduced to a much greater extent.

In relation to each of the virtual pixel rows 82 arranged in the base area S0 along the conveyance direction, the standard area formation section 44 calculates a new number of continual pixels by multiplying, by a scale-up factor, the number of continual virtual pixels 81 in the pixel group that is grouped by the virtual pixels 81*a* to 81*d* and that includes one or a plurality of virtual pixels 81 that are not flushing candidate pixels. The standard area formation section 44 forms the standard areas S in such a way that the number of continual pixels in each of the pixel groups becomes equal to the calculated number of continual pixels. Therefore, the plurality of standard areas S commensurate with the plurality of resolutions for the conveyance direction can readily be formed.

Example Modification

Example modifications of the present invention are now described. In the foregoing embodiment, the flushing data storage section 43 is configured so as to store flushing data including flushing patterns for four colors black, magenta, cyan, and yellow having a plurality of flushing candidate pixels as pixels. The flushing data storage section, however, can store flushing data including only one flushing pattern. The extraction section at this time virtually arranges the virtual flushing area F, for each inkjet head 1, at a randomly-determined position within the reference area Ref for the flushing data. Further, in the range where there are overlaps with the virtual pixel rows 84 not associated with the image dots of the virtual flushing area F, the extraction section extracts, as flushing pixels for the virtual flushing area F, pixels overlapping pixels that are flushing candidate pixels in the reference area Ref.

The essential requirement for the flushing data storage section 43 is to store flushing data including the flushing pattern pertaining to one inkjet head 1, so that the storage capacity of the flushing data storage section 43 can be reduced.

The preferred embodiment of the present invention has been described thus far. However, the present invention is not limited to the foregoing embodiment and susceptible to various alterations within the scope of claims. In the foregoing embodiment, each of the pixel rows, which is made up of a plurality of pixels arranged in the conveyance direction for the four flushing patterns included in the flushing data stored in the flushing data storage section 43, is configured so as to include, at mutually-different locations with respect to the conveyance direction, the virtual pixels 81*a* to 81*d* that are flushing candidate pixels. However, each of the pixel rows can have pixels, which are the flushing candidate pixels, at the same locations with respect to the conveyance direction.

In the foregoing embodiment, the extraction section 46 is configured in such a way that the virtual flushing area F is virtually arranged at a randomly-determined position in the reference area Ref. The extraction section can also be configured in such a way that the virtual flushing area F is virtually arranged at a position determined on the basis of a previously-stored pattern. The pattern can also change periodically.

In the foregoing embodiment, the reference area formation section 45 is configured so as to form the reference area Ref by arranging two standard areas S adjacently to each other in both the main scan direction and the conveyance direction. However, the reference area formation section can also be configured so as to form the reference area Ref by arranging an arbitrary number of standard areas S adjacently to each other in both the main scan direction and the conveyance direction. For instance, the reference area Ref can also be formed by arranging two standard areas S adjacently to each other in both the main scan direction and the conveyance direction. Alternatively, the reference area Ref can also be formed by letting the virtual pixels 81 of a standard area S repeatedly appear in at least the main scan direction or the conveyance direction and in units equal in number to the virtual pixels 81 arranged in the standard area S in the same direction, in such a way that the virtual pixels 81 arranged from one end of the standard area S become adjacent to virtual pixels 81 arranged toward the other end of the standard area S with respect to the same direction.

In the foregoing embodiment, the flushing data storage section 43 is configured so as to store the base area S0 commensurate with the lowest resolution among the resolutions for the conveyance direction at which the inkjet printer 101 can produce a print. However, The flushing data storage section can also be configured so as to store the base area S0 commensurate with another resolution for the conveyance direction.

In the foregoing embodiment, the standard area formation section 44 is configured so as to form the standard area S by means of inserting virtual pixels 81 into each of the pixel groups in each of the virtual pixel rows 82 arranged in the base area S0 along the conveyance direction, in such a way that each of the pixel groups that is grouped by the virtual pixels 81*a* to 81*d* and that includes one or a plurality of virtual pixels 81 which are not flushing candidate pixels assumes a new number of continual pixels determined by multiplying, by a scale-up factor, the number of continual virtual pixels 81 in the pixel group. However, the configuration of the standard area formation section for forming the standard area S from the base area S0 can be arbitrary.

In the foregoing embodiment, each of the virtual pixel rows 82 of the base area S0 is configured so as to include one flushing candidate pixel in one inkjet head 1. However, each of the virtual pixel rows 82 can also be configured so as to include two or more flushing candidate pixels in one inkjet head 1.

In the embodiment, the number of pixels arranged in the virtual flushing area F along the conveyance direction is equal to a quotient obtained by dividing the length of the print area achieved in the conveyance direction by the distance equivalent to the resolution for the conveyance direction. However, the number of pixels arranged in the virtual flushing area F along the conveyance direction can also be smaller than the quotient.

In the embodiment, the flushing data storage section 43 stores a number equal to the number of the virtual pixels in the virtual flushing area F as the number of virtual pixels for the base area S0 to be arranged in the main scan direction. The flushing data storage section can also store instead a number equal to or smaller than a quotient obtained by dividing the length of the flushing area (the print area) achieved in the main scan direction by a unit distance commensurate with the resolution for the main scan direction. When the standard area S is formed, the flushing data storage section 43 enlarges virtual pixels in such a way that a virtual pixel row repeatedly appears in units equal to the previously-stored number of virtual pixels to be formed in the base area S0 with respect to the main scan direction. The flushing data storage section 43 performs enlargement processing until virtual pixel rows required to make up the virtual flushing area F are arranged. Small memory capacity is sufficient in this case.

In the foregoing embodiment, the base area S0 is a virtual area defined at the lowest resolution for the conveyance direction. However, the base area S0 must be specified at the highest resolution at least for the conveyance direction. The same also applies to the base area in connection with the other direction as well. However, in view of small memory capacity, it is much better to specify the base area at the smallest resolution for both directions.

In the foregoing embodiment, when the standard area formation section 44 forms a standard area S by enlarging the base area S0, addition of virtual pixels commensurate with enlargement of the respective flushing candidate pixels is performed by adding one virtual pixel so as to immediately follow each of the flushing candidate pixels. However, the virtual pixel can be placed at an arbitrary position, so long as the position is in the same virtual pixel row. For instance, in order to add one pixel corresponding to the flushing candidate pixel, the pixel can also be interposed between the flushing candidate pixel and the next flushing candidate pixel. The standard area S can thereby be formed in a pattern analogous to an arrangement pattern of flushing candidate pixels in the base flushing pattern. Further, all virtual pixels to be added can also collectively be arranged before the head or after the end of the virtual pixel row.

In the foregoing embodiment, the flushing area and the print area are configured so as to match each other. However, as mentioned previously, the essential requirement is that the flushing area should match the print area in the main scan direction and occupy a portion of the print area in the conveyance direction. All the standard area formation section 44 has to do is to enlarge each of the virtual pixel rows by multiplying, by a scale-up factor, the number of continual virtual pixels in the virtual pixel group made up of the virtual pixels that are not the flushing candidate pixels. The standard areas S are formed from the base area S0 by means of simple processing. Processing for enlarging flushing candidate pixels themselves and processing for adjusting an excess or deficiency in virtual pixels in each of virtual pixel rows for letting the flushing area match the print area are not necessary at this time.

Although the base area S0 and the standard areas S have been described as including only one of the virtual pixels 81*a* to 81*d* in each of the virtual pixel rows for each color, the plurality of virtual pixels 81*a* to 81*d* can also be included.

When the scale-up factor is not an integral multiple in the foregoing embodiment, processing for enlarging the area by use of an integral multiple closest to the value of the scale-up factor is performed. However, an integral multiple obtained by rounding up a value of a product may also be used. Alternatively, an integral value obtained by rounding down a value of a product may also be used.

The present invention is also applicable to a recorder that ejects a liquid other than ink. The present invention is not limited to the printer but is also applicable to a facsimile, a copier, and the like. Further, the present invention is also applicable to a computer readable recording memory storing a program which causes the recorder to function as described above. In the above exemplary embodiments, the EEPROM storing the program is employed as an example of the computer readable recording medium according to the invention. However, the computer readable recording medium according to the invention is not limited to the EEPROM. The computer readable recording medium according to the invention may be any computer readable recording medium, such as a hard disk, an optical disk (CD-ROM, DVD-ROM, etc.), flash memory and the like, storing the program.

What is claimed is:

1. A recording apparatus comprising:

a conveyance mechanism which conveys a recording medium in a conveyance direction;

a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction;

an image data storage which stores image data showing, in a recording area defined in the recording medium, positions of image dots produced at intervals commensurate with the first resolution in the orthogonal direction and a second resolution in the conveyance direction;

a flushing area size storage which stores the number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

a standard flushing data storage which stores standard flushing data showing a standard flushing pattern within a standard area, wherein the standard area includes a plurality of element rows having spatial elements arranged in the conveyance direction and has the same matrix shape as the virtual flushing area, and the standard flushing pattern includes flushing coordinate elements which are selected at least one from the spatial elements of each of the element rows of the standard area;

a reference area formation unit which repeatedly arranges the plural standard areas in at least one of the conveyance direction and the orthogonal direction to form a reference area;

an extraction unit which virtually arranges the virtual flushing area on an arbitrary position within the reference area, and selects the element row, in which the image dot is not included, from the element rows of the flushing area when the recording area is arranged on the flushing area, and extracts the coordinate element within the reference area in the selected element row as a flushing element; and an ejection controller which controls the ejection ports to eject droplets based on the image data and the flushing element extracted by the extraction unit.

2. The recording apparatus according to claim 1, wherein the number of the spatial elements of the virtual flushing area in the conveyance direction is smaller than the second resolution.

3. The recording apparatus according to claim 1, wherein a plurality of the liquid ejection heads are provided in the recording apparatus, the standard flushing data stored in the standard flushing data storage include a plurality of the standard flushing pattern which are different from each other and corresponds to the liquid ejection heads, respectively, and the plurality of element rows belonging to the plurality of standard flushing patterns located at the same position in the orthogonal direction have the flushing candidate elements at positions differing from each other in the conveyance direction.

4. The recording apparatus according to claim 1, wherein a plurality of the liquid ejection heads are provided in the recording apparatus, the standard flushing data stored in the standard flushing data storage include the standard flushing pattern common to the plurality of liquid ejection heads; and the extraction unit virtually arranges the virtual flushing area at an arbitrary position in the reference area for each of the liquid ejection heads and extracts flushing elements in the virtual flushing area.

5. The recording apparatus according to claim 1, wherein the extraction unit virtually arranges the virtual flushing area at the arbitrary position randomly determined in the reference area.

6. The recording apparatus according to claim 1, wherein the reference area formation unit arranges the standard areas adjacently to each other in both the conveyance direction and the orthogonal direction to form the reference area.

7. The recording apparatus according to claim 1, wherein the ejection controller can form, on the recording medium, the plurality of image dots corresponding to the image data at a plurality of second resolutions differing from each other;

the standard flushing data storage stores base flushing data showing a base flushing pattern in a base area, wherein the base area includes spatial elements in the orthogonal direction equal in number to the spatial elements in the virtual flushing area and spatial elements, whose number corresponds to one of the second resolutions, in the conveyance direction, and the base flushing pattern includes flushing coordinate elements which are selected at least one from the spatial elements of each of the element rows of the base area; and the recording apparatus further comprises a standard area formation unit which forms the standard flushing data pertaining to the standard area based on the base flushing data pertaining to the base area and which stores the formed standard flushing data in the standard flushing data storage.

8. The recording apparatus according to claim 7, wherein the standard flushing data storage stores the base flushing data pertaining to the smallest second resolution among the plurality of second resolutions, and the standard area formation unit forms the standard area in such a way that the number of the spatial elements except the flushing candidate elements in the respective element rows of the plurality of spatial elements arranged in the standard area in the conveyance direction comes to an integer closest to a product which is obtained by multiplying the number of the spatial elements except the flushing candidate elements in the respective element rows of the plurality of spatial elements arranged in the base area along the conveyance direction by a ratio of the second resolution of an image produced on a recording medium to the lowest second resolution.

9. The recording apparatus according to claim 1, wherein a length of the virtual flashing area in the orthogonal direction corresponds to a length of an area, in which the plurality of ejection ports are arranged, in the orthogonal direction.

10. A method of controlling a recording apparatus which includes a conveyance mechanism which conveys a recording medium in a conveyance direction; and a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction, the method comprising:

storing image data showing, in a recording area defined in the recording medium, positions of image dots produced at intervals commensurate with the first resolution in the orthogonal direction and a second resolution in the conveyance direction;

storing a number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

storing standard flushing data showing a standard flushing pattern within a standard area, wherein the standard area includes a plurality of element rows having spatial elements arranged in the conveyance direction and has the same matrix shape as the virtual flushing area, and the standard flushing pattern includes flushing coordinate elements which are selected at least one from the spatial elements of each of the element rows of the standard area;

repeatedly arranging plural standard areas in at least one of the conveyance direction and the orthogonal direction to form a reference area;

virtually arranging the virtual flushing area on an arbitrary position within the reference area;

selecting the element row, in which the image dot is not included, from the element rows of the flushing area when the recording area is arranged on the flushing area, and extracting the coordinate element within the reference area in the selected element row as a flushing element; and controlling the ejection ports to eject droplets based on the image data and the extracted flushing element.

11. A computer readable storage device storing a program which causes a recording apparatus, which includes a conveyance mechanism which conveys a recording medium in a conveyance direction; and a liquid ejection head including a plurality of ejection ports which eject droplets toward the recording medium conveyed by the conveyance mechanism, to produce image dots, and which are arranged at intervals commensurate with a first resolution in a direction orthogonal to the conveyance direction, to perform:

storing image data showing, in a recording area defined in the recording medium, positions of image dots produced at intervals commensurate with the first resolution in the orthogonal direction and a second resolution in the conveyance direction;

storing a number of virtual pixels arranged in the conveyance direction in a virtual flushing area in which a flushing area is represented in a virtual space, wherein the flushing area occupies a whole area of the recording area in the orthogonal direction and occupies at least a part of the recording area in the conveyance direction, and the flushing area includes a plurality of element rows having spatial elements arranged in the conveyance direction, the plurality of element rows being arranged in the orthogonal direction;

storing standard flushing data showing a standard flushing pattern within a standard area, wherein the standard area includes a plurality of elements rows having spatial elements arranged in the conveyance direction and has the same matrix shape as the virtual flushing area, and the standard flushing pattern includes flushing coordinate elements which are selected at least one from the spatial elements of each of the element rows of the standard area;

repeatedly arranging plural standard areas in at least one of the conveyance direction and the orthogonal direction to form a reference area;

virtually arranging the virtual flushing area on an arbitrary position within the reference area;

selecting the element row, in which the image dot is not included, from the element rows of the flushing area when the recording area is arranged on the flushing area, and extracting the coordinate element within the reference area in the selected element row as a flushing element; and controlling the ejection ports to eject droplets based on the image data and the extracted flushing element.

* * * * *